US011338994B2

(12) United States Patent
Wang et al.

(10) Patent No.: US 11,338,994 B2
(45) Date of Patent: May 24, 2022

(54) INDUCTION ACTUATION TRASH CONTAINER WITH ACTUATION ARM

(71) Applicant: FUJIAN NASHIDA ELECTRONIC INCORPORATED COMPANY, Fujian (CN)

(72) Inventors: Xin Wang, Fuzhou (CN); Wenbin Ye, Fuzhou (CN); Shaoming Chen, Fuzhou (CN); Laixu Zou, Fuzhou (CN)

(73) Assignees: Nine Stars Group (U.S.A.) INC., Chino, CA (US); Fujian Nashida Electronic Incorporated Company, Fujian (CN)

( * ) Notice: Subject to any disclaimer, the term of this patent is extended or adjusted under 35 U.S.C. 154(b) by 214 days.

(21) Appl. No.: 16/612,356

(22) PCT Filed: May 19, 2017

(86) PCT No.: PCT/CN2017/084997
§ 371 (c)(1),
(2) Date: Nov. 8, 2019

(87) PCT Pub. No.: WO2018/205297
PCT Pub. Date: Nov. 15, 2018

(65) Prior Publication Data

US 2020/0115158 A1 Apr. 16, 2020

(30) Foreign Application Priority Data

May 8, 2017 (CN) ..... 201720499804.X

(51) Int. Cl.
*B65F 1/16* (2006.01)
*B65F 1/06* (2006.01)

(52) U.S. Cl.
CPC ..... *B65F 1/1638* (2013.01); *B65F 1/06* (2013.01); *B65F 2210/168* (2013.01)

(58) Field of Classification Search
CPC ..... B65F 1/1623; B65F 1/1638; B65F 1/06; B65F 2210/168; B65D 2590/664; B65D 43/26
(Continued)

(56) References Cited

U.S. PATENT DOCUMENTS 8,678,219 B1 * 3/2014 Wang ..... B65F 1/163 220/211
2008/0264942 A1 * 10/2008 Shek ..... B65F 1/1638 220/211
(Continued)

*Primary Examiner* — J. Gregory Pickett
*Assistant Examiner* — Niki M Eloshway
(74) *Attorney, Agent, or Firm* — Raymond Y. Chan; David and Raymond Patent Firm

(57) ABSTRACT

An induction actuation trash container with actuation arm includes an upper container body, a pressing ring and a lower container body. The upper container body includes a cover panel, a main housing body, a body seat, an actuation arm, a rotating shaft, and an induction actuated arrangement. The main housing body has an indented cavity formed at a rear side of an inner side of the main housing body, wherein the rotating shaft is mounted across the indented cavity and penetrates through a left sidewall and an opposing right sidewall thereof. One end of the rotating arm is coupled to the rotating shaft while the other end of the rotating arm is fixedly screwed to the cover panel. The induction actuated arrangement is disposed in an interior space defined between the main housing body and the body seat when the main housing body is engaged with the body seat, wherein an actuation output of the induction actuated arrangement is operatively coupled with one end portion of the rotating shaft for generating a rotational force to drive the rotating shaft to rotate and pivotally move the actuation arm.

5 Claims, 8 Drawing Sheets

(58) Field of Classification Search
USPC ..... 220/495.06, 829, 211
See application file for complete search history.

(56) References Cited

U.S. PATENT DOCUMENTS

| | | | | |
|---|---|---|---|---|
| 2011/0049149 | A1* | 3/2011 | Shih | B65F 1/1607 220/260 |
| 2011/0074316 | A1* | 3/2011 | Shek | B65F 1/1607 318/3 |
| 2013/0233853 | A1* | 9/2013 | Yang | B65F 7/00 220/211 |
| 2013/0233857 | A1* | 9/2013 | Yang | B65F 1/04 220/495.08 |
| 2014/0184110 | A1* | 7/2014 | Wang | H02P 1/02 318/139 |
| 2015/0259140 | A1* | 9/2015 | Yang | B65F 1/1646 220/211 |
| 2018/0079592 | A1* | 3/2018 | Wang | B65F 1/1646 |
| 2018/0229931 | A1* | 8/2018 | Shek | B65F 1/1638 |
| 2019/0055087 | A1* | 2/2019 | Wang | B65F 1/1638 |
| 2019/0077595 | A1* | 3/2019 | Wang | B65F 1/16 |

* cited by examiner

INDUCTION ACTUATION TRASH CONTAINER WITH ACTUATION ARM

CROSS REFERENCE OF RELATED APPLICATION

This is a U.S. National Stage Non-Provisional Application under 35 U.S.C. 371 of the International Application, Application Number PCT/CN2017/084997, filed 19 May 2017, which claims priority under 35 U.S.C. 119(a-d) to Chinese application number 201720499804.X, filed 8 May 2017.

BACKGROUND OF THE PRESENT INVENTION

Field of Invention

The present invention relates to trash container, and more particularly to an induction actuated trash container.

Description of Related Arts

Most conventional induction trash containers have the same cover panel opening configuration implemented by a rotating shaft penetrated through the cover panel and hinged to a main housing body. However, the cover panel, when it is opened, positioned at the rear side of the rotating shaft generally takes up certain s of the main housing body, which makes it difficult to design a trash container with compact and aesthetical appearance. In addition, it is also more troublesome in replacement of the cover panel as well as having poor waterproof performance. Since the induction trash container would inevitably encounter a need for maintenance during use, it is desired that the repairing and replacement of certain components can be as simple and convenient as possible. However, with the conventional cover panel opening configuration, it is troublesome to detach, replace and remount the cover panel for the conventional trash container. Moreover, the conventional trash container has a relatively poor waterproof performance, that the moisture in the trashes will cause erosion on the circuit board and some mechanical parts of the trash container, shortening the life span thereof. Furthermore, the trash container with complex shape also increases people's sense of fatigue when it is used at home.

For instance, patent number CN03217227.3 discloses a "smart automatic flip-cover trash container" whose cover panel opening is implemented by a transmission bar, wherein one end of the transmission bar is coupled to the cover panel while the other end thereof is engaged with a gear. With such configuration, the gear and the internal space of the trash container for storing trashes cannot be isolated, resulting in relatively poor waterproof and moisture resistance performance.

SUMMARY OF THE PRESENT INVENTION

The invention is advantageous in an induction actuated trash container with actuation arm, which has a reasonable design and a compact structure. Moreover, its cover panel opening mechanism is novel while having a relatively good waterproof and moisture resistance performance.

According to the present invention, the foregoing and other objects and advantages are attained by an induction actuated trash container with actuation arm, which comprises an upper container body, a pressing ring and a lower container body.

The upper container body comprises a cover panel, a main housing body, a body seat, an actuation arm, a rotating shaft, and an induction actuated arrangement, wherein the main housing body has an indented cavity formed on an inner side of the main housing body at a rear side thereof, wherein the rotating shaft is mounted across the indented cavity and penetrating from a left sidewall to an opposed right sidewall thereof, wherein one end of the actuation arm is coupled to the rotating shaft while the other end of the actuation arm is coupled to the cover panel. The induction actuated arrangement is disposed in an interior space defined between the main housing body and the body seat when the main housing body is engaged with the body seat. An actuation output of the induction actuated arrangement is operatively coupled with one end portion of the rotating shaft for generating a rotational force to the rotating shaft so as to pivotally move the actuation arm.

Further, in one embodiment of the present invention, the actuation arm having a U-shaped structure has an elongated circular through bore provided at an end thereof in the indented cavity, wherein the rotating shaft passes through and is fixedly screwed in the through bore.

Further, in one embodiment of the present invention, two end portions of the rotating shaft are positioned and hidden in the interior space formed between the body seat and the main housing body engaged on the body seat, wherein a sector gear is coupled at one end portion of the rotating shaft while the other end portion of the rotating shaft is sleeved with a resilient element, wherein one end of the resilient element is biased against an inner surface of the main housing body for providing an urging force to balance the gravity of the cover panel.

Further, in one embodiment of the present invention, the induction actuated arrangement comprises a circuit board, an electric driving unit such as a servo motor driven by the circuit board, and a reduction gear unit coupled with the driving unit, wherein the reduction gear unit comprises an output gear engaged with the sector gear.

Further, in one embodiment of the present invention, the pressing ring comprises an outer pressing ring and an inner pressing ring, wherein the outer pressing ring is provided between the upper container body and the lower container body for connecting the upper container body and the lower container body, wherein the inner pressing ring is mounted at an inner side of the outer pressing ring to form a gap therebetween, wherein when a trash bag is sleeved in the lower container body the peripheral edge of the trash bag at the opening thereof can be folded outward and downward to hook up in the gap between inner pressing ring and the outer pressing ring.

In one embodiment of the present invention, the upper container body further comprises a pair of shaft supporting bases provided at a left sidewall and a right sidewall of the indented cavity respectively, wherein two end portions of the rotating shaft are supported on the shaft supporting bases respectively.

Compared with the conventional art, the trash container according to the present invention has the following advantages.

The trash container has a reasonable design and compact structure. The trash container is easy to assemble and disassemble, which facilitates easier installation and maintenance. The mechanism of opening the cover panel of the trash container is novel that the induction actuated arrangement is separated from the trashes contained in the trash container, such that the trash container has a relatively good poor waterproof and moisture resistance performance during use. The induction actuated arrangement utilizes gear for force transmission, which has a constant transmission torque and high transmission efficiency, such that the life span of the trash container can be prolonged.

Still further objects and advantages will become apparent from a consideration of the ensuing description and drawings.

These and other objectives, features, and advantages of the present invention will become apparent from the following detailed description, the accompanying drawings, and the appended claims.

Figure 1:
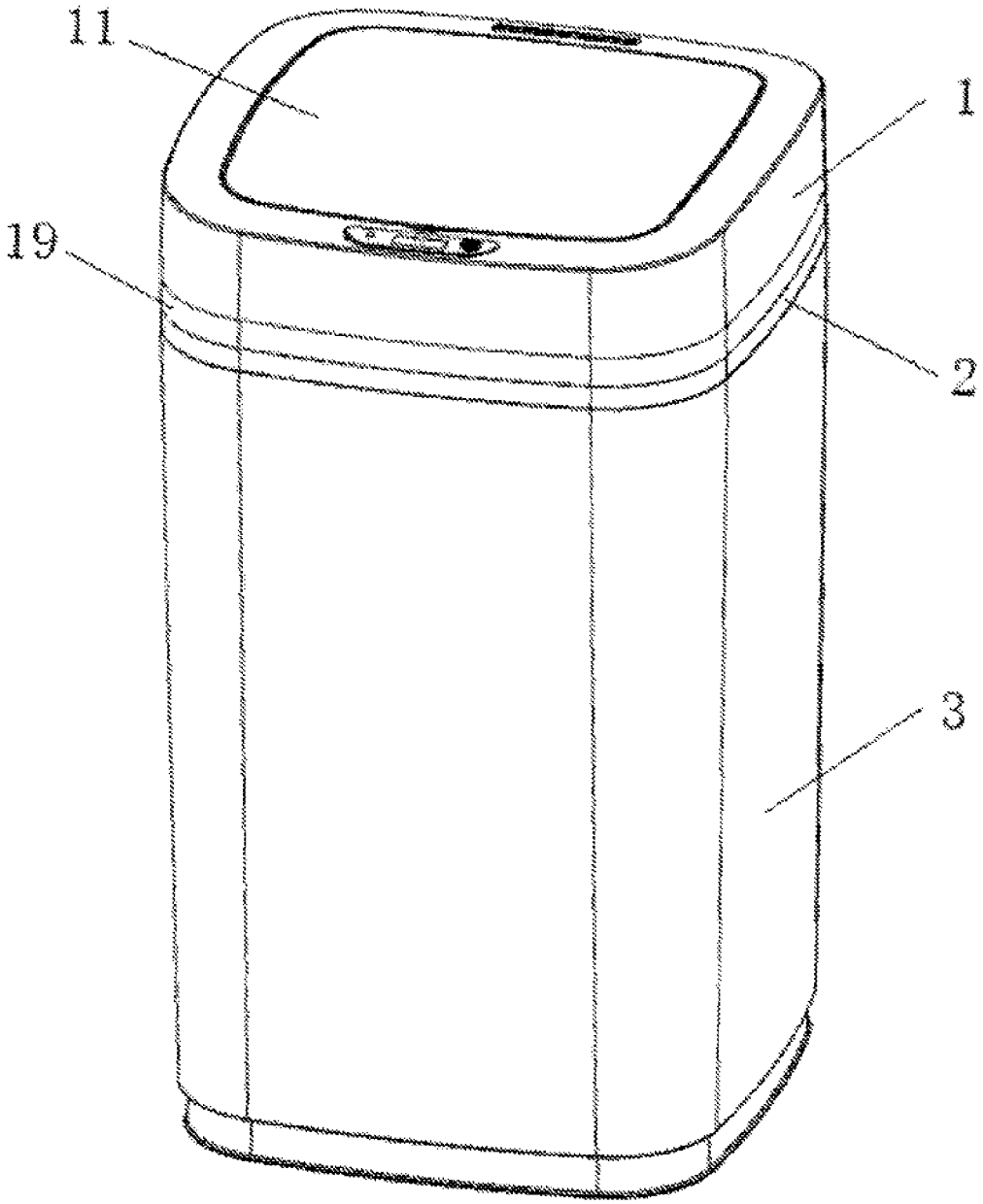
FIG. 1 is a perspective view of an induction actuated trash container according to a preferred embodiment of the present invention.
Figure 2:
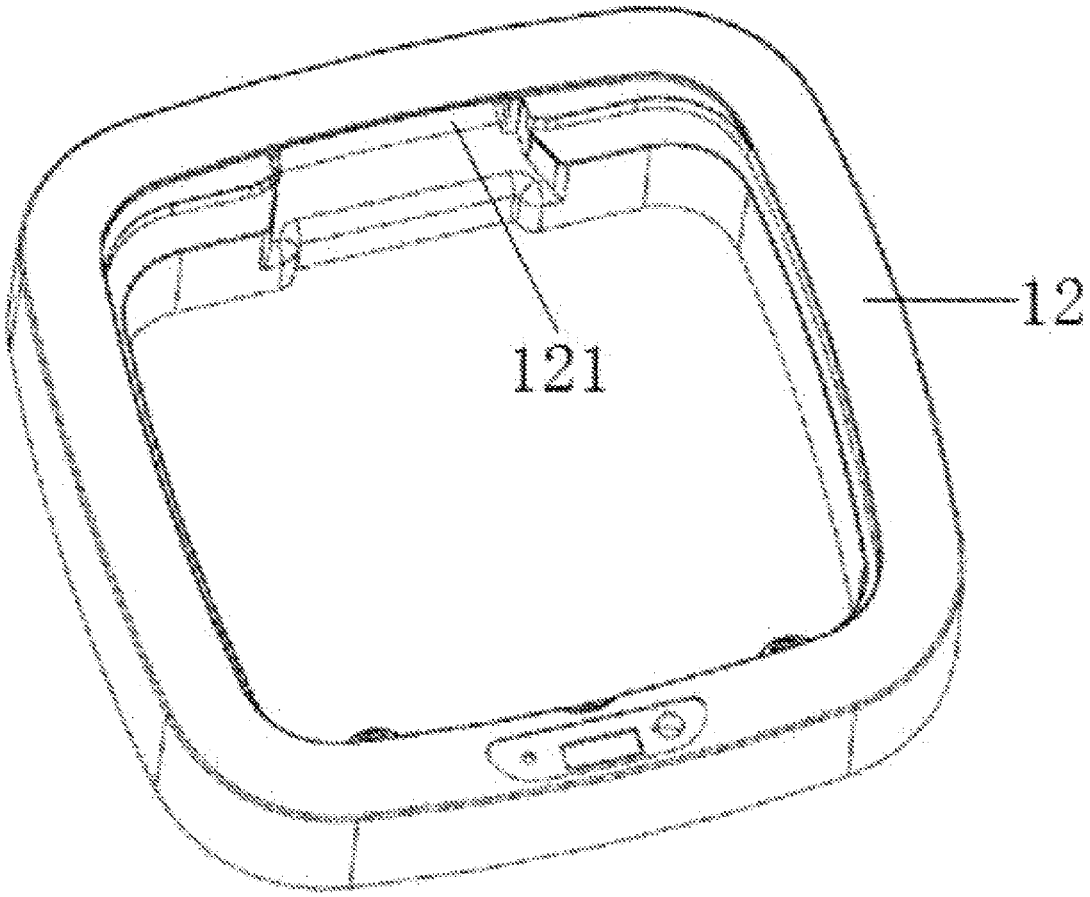
FIG. 2 is a perspective view of a main housing body of the induction actuated trash container according to above preferred embodiment of the present invention.
Figure 3:
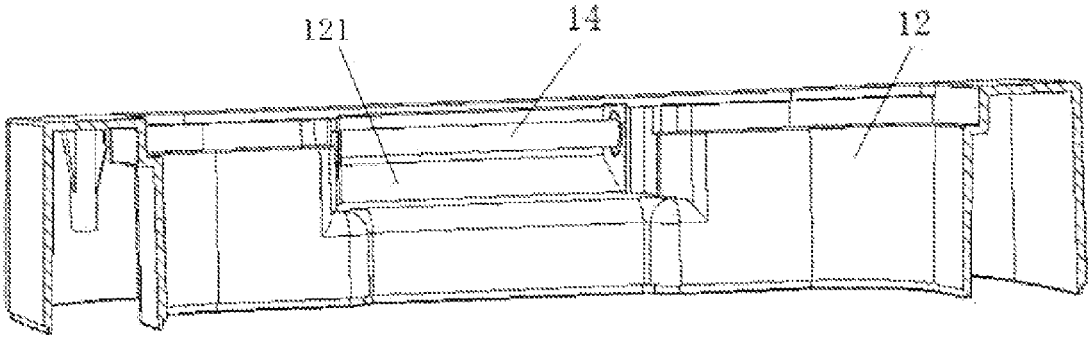
FIG. 3 is schematic diagram illustrating a rotating shaft is mounted in an indented cavity of the induction actuated trash container according to above preferred embodiment of the present invention.

In the drawings: 1—upper container body, 11—cover panel, 12—main housing body, 121—indented cavity, 13—actuation arm, 131—circular through bore, 14—rotating shaft, 15—induction actuated arrangement, 151—circuit board, 1511—infrared sensor, 152—driving unit, 153—reduction gear unit, 1531—output gear of the reduction gear unit, 16—sector gear, 17—resilient element, 18—shaft supporting base, 19—body base, 2—pressing ring, 21—outer pressing ring, 22—inner pressing ring, 3—lower container body, and 4—trash bag.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. just indicate relations of direction or position are based on the relations of direction or position shown in the appended drawings, which is only to facilitate descriptions of the present invention and to simplify the descriptions, rather than to indicate or imply that the referred device or element must apply specific direction or to be operated or configured in specific direction. Therefore, the above mentioned terminologies shall not be interpreted as confine to the present invention.

It is understandable that the term "a" should be understood as "at least one" or "one or more". In other words, in one embodiment, the number of an element can be one and in other embodiment the number of the element can be greater than one. The term "a" is not construed as a limitation of quantity.

Referring to FIGS. 1 to 6 of the drawings, an induction actuated trash container according to a preferred embodiment of the present invention is illustrated, which is embodied as a sensing flip cover trash can comprising an upper container body 1, a pressing ring 2 and a lower container body 3. The upper container body 1 comprises a cover panel 11, a main housing body 12, a body seat 19, an actuation arm 13, a rotating shaft 14, and an induction actuated arrangement 15. The main housing body 12 has an indented cavity 121 formed at a rear side of an inner side of the main housing body 12, wherein the rotating shaft 14 is mounted across the indented cavity 121 and penetrates through a left sidewall and an opposing right sidewall of the main housing body 12 defining the indented cavity 121 therebetween. One end of the actuation arm 13 is coupled to the rotating shaft 14, while the other end of the actuation arm 13 is fixed to the cover panel 11 by screwing. The induction actuated arrangement 15 is disposed in an interior space defined between the main housing body 12 and the body seat 19 when the main housing body 12 is engaged with the body seat 19, wherein an actuation output of the induction actuated arrangement 15 is operatively coupled with one end portion of the rotating shaft 14 for generating a rotational force to the rotating shaft 14 so as to pivotally move the actuation arm 13 to open the cover panel 11.

Figure 7:
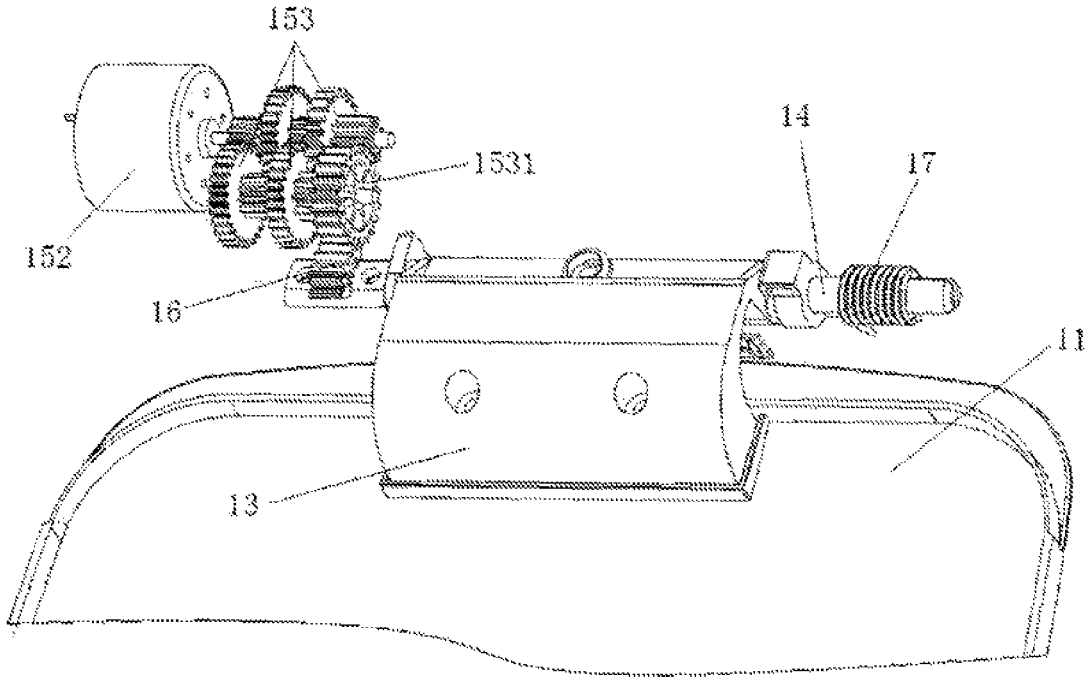
FIG. 7 is a perspective view illustrating the induction actuated arrangement coupled with the rotating shaft according to the above preferred embodiment of the present invention.
Figure 8:
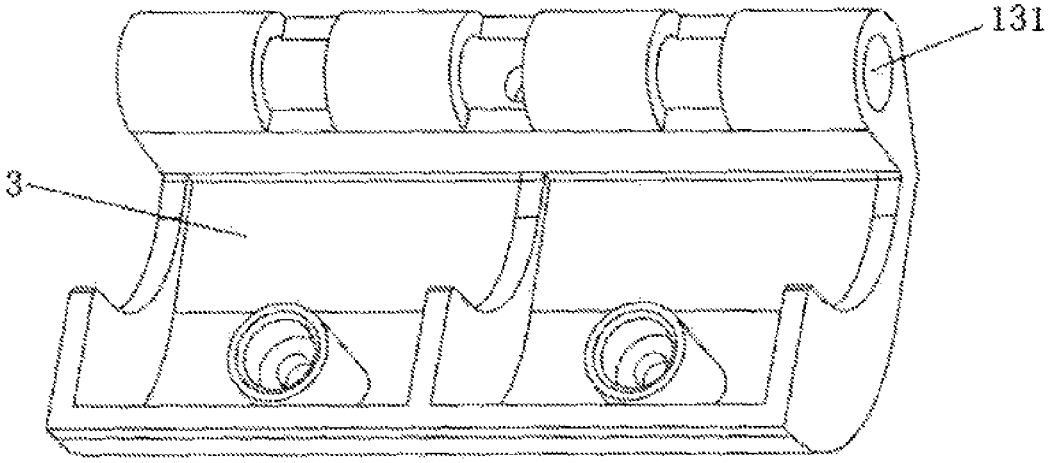
FIG. 8 is a perspective view of an actuation arm of the trash container according to the above preferred embodiment of the present invention.

According to the preferred embodiment of the present invention, the actuation arm 13, having a U-shaped structure, has an elongated circular through bore 131 provided at an end thereof in the indented cavity 121, as shown in FIG. 8, wherein the rotating shaft 14 passes through and fixed in the through bore 131 by screwing, as shown in FIGS. 6 to 9. The actuation arm 13 is received and hidden within the indented cavity 121 when the cover panel 11 is closed, and the actuation arm 13 won't interfere and be crashed with the main housing body 12 when the cover panel 11 is being opened. Accordingly, the overall appearance of the trash container can be more aesthetic.

According to the preferred embodiment of the present invention, two end portions of the rotating shaft 14 are positioned and hidden in the interior space formed between the body seat 19 and the main housing body 12 engaged on the body seat 19, wherein a sector gear 16 is coupled at one end portion of the rotating shaft 14, while a resilient element 17 is provided and sleeved on the other end portion of the rotating shaft 14. In particular, one end of the resilient element 17 is biased against an inner surface of the main housing body 12 for providing an urging force to balance the gravity of the cover panel 11.

According to the preferred embodiment of the present invention, the induction actuated arrangement 15 and the two end portions of the rotating shaft 14 are positioned in the interior space formed between the body seat 19 and the main housing body 12 engaged on the body seat body seat 19, such that the induction actuated arrangement 15 and the two end portions of the rotating shaft 14 are isolated from the trashes stored in the storage cavity of the trash container. In other words, the trash container according to the preferred embodiment of the present invention has better waterproof and moisture resistance performance during use.

Figure 9:
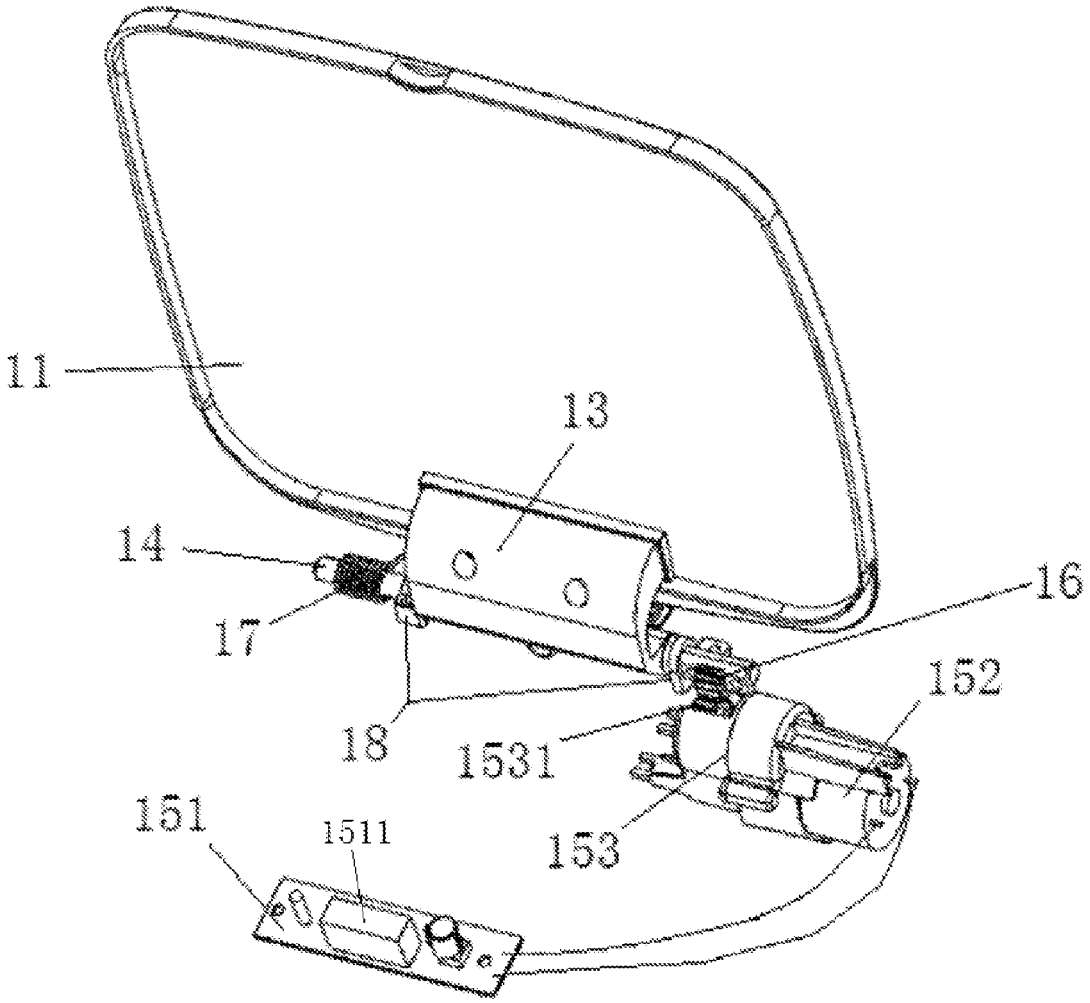
FIG. 9 is a perspective view of the induction actuated arrangement of the trash container according to the above preferred embodiment of the present invention.

Referring to FIG. 7 and FIG. 9 of the drawings, the induction actuated arrangement 15 comprises a circuit board 151, an electric driving unit 152, such as a servo motor, controlled and driven by the circuit board 151, and a reduction gear unit 153 coupled with the driving unit 152. The reduction gear unit 153 comprises an output gear 1531 engaged with the sector gear 16. When an infrared sensor 1511 installed on the circuit board 151 detects a user or an object is approaching, the induction actuated arrangement 15 is activated that the circuit board 151 controls the driving unit 152 to rotate and generate a rotational force to drive the reduction gear unit 153 to rotate, wherein the sector gear 16 coupled to the rotating shaft 14 is driven by the output gear 1531 of the reduction gear unit 153 to rotate to drive the actuation arm 13 to rotate and pivotally drive and move the cover panel 11 to open, as shown in FIGS. 7 and 9.

Figure 4:
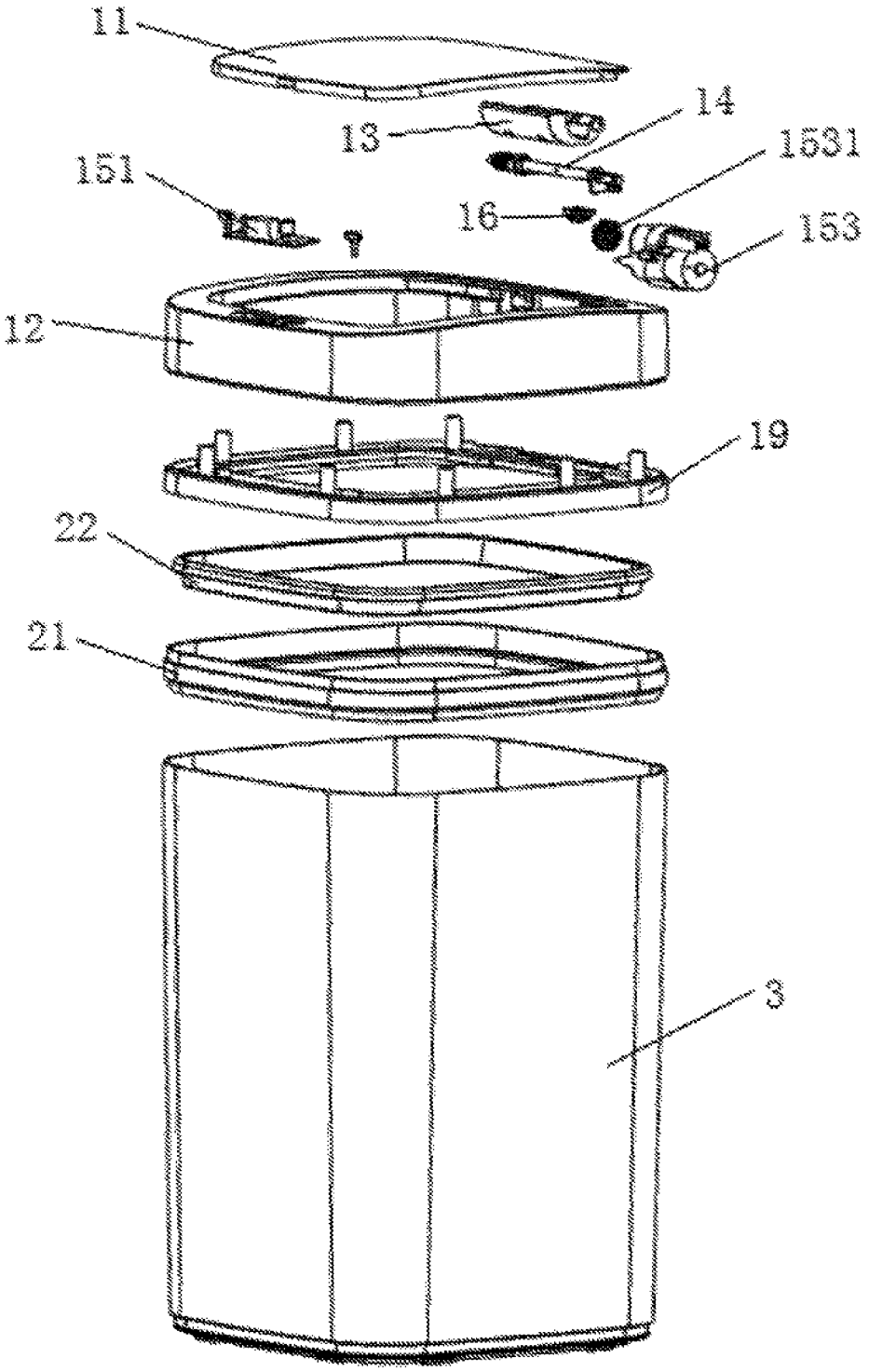
FIG. 4 is an explosive view of the induction actuated trash container according to the above preferred embodiment of the present invention.
Figure 5:
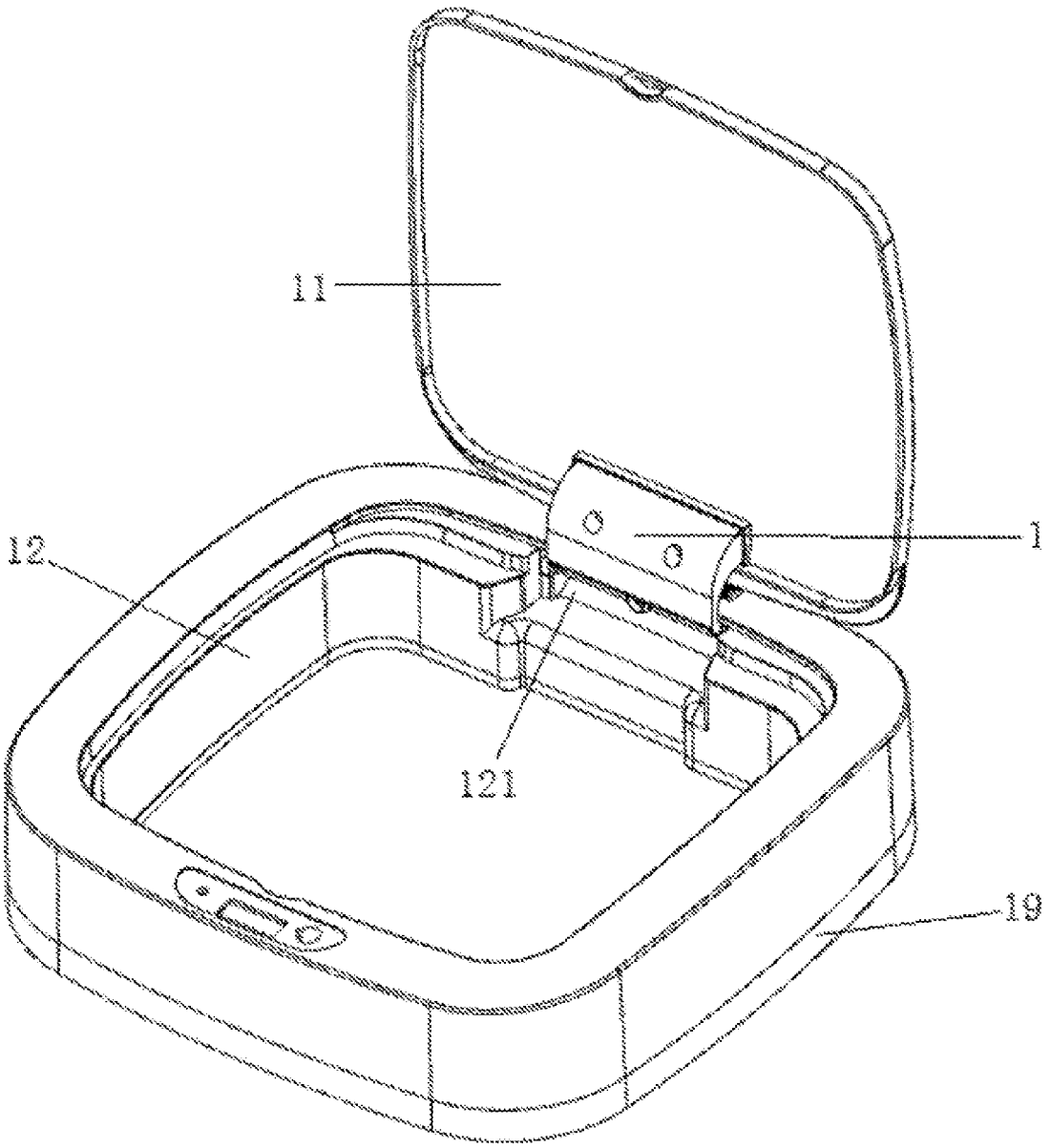
FIG. 5 is perspective view illustrating an upper container body of the trash container in its opened position according to the above preferred embodiment of the present invention.
Figure 6:
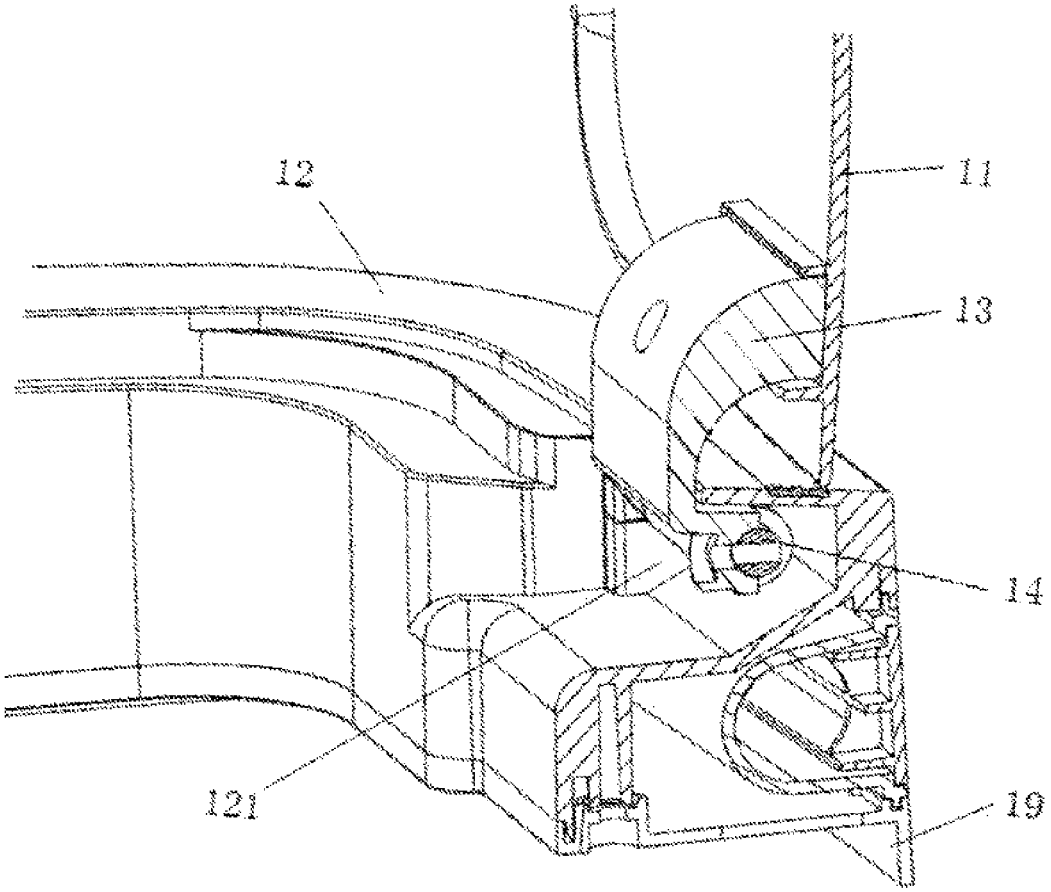
FIG. 6 is a partial sectional perspective view of the upper container body of the trash container according to the above preferred embodiment of the present invention.
Figure 10:
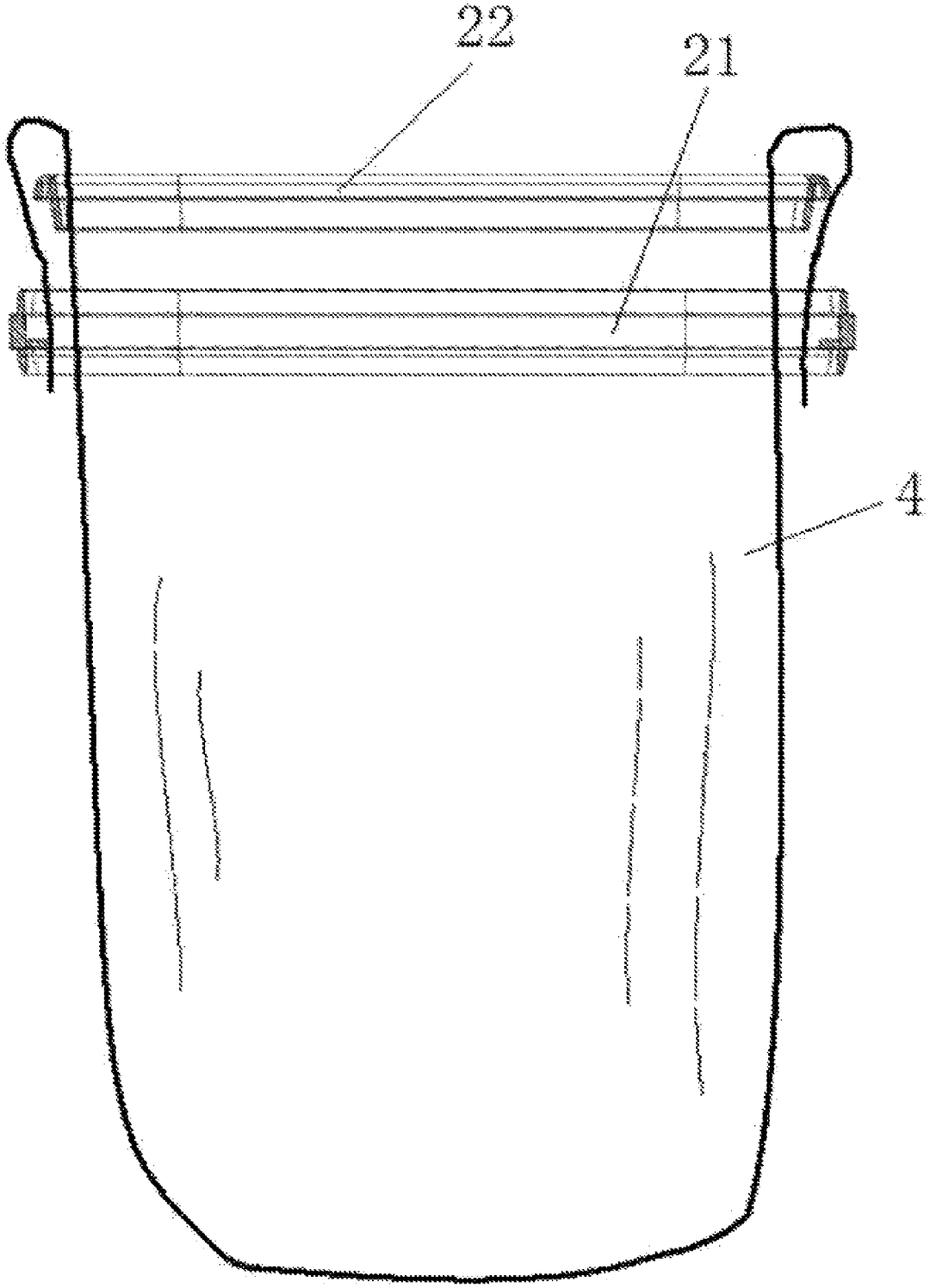
FIG. 10 is a perspective view illustrating a trash bag mounted between an inner pressing ring and an outer pressing ring of the trash container according to the above preferred embodiment of the present invention.

Referring to FIGS. 1, 4 and 10 of the drawings, according to the preferred embodiment of the present invention, the pressing ring 2 comprises an outer pressing ring 21 and an inner pressing ring 22, wherein the outer pressing ring 21 is provided between the upper container body 1 and the lower container body 3 for connecting the upper container body 1 with the lower container body 3 such that the outer surface of upper container body 1 is aligned with the outer surface of the lower container body 3 on the same plane to form an integrity smooth outer surface of the trash container so as to enhance the overall aesthetic appearance of the trash container. The inner pressing ring 22 is mounted at an inner side of the outer pressing ring 21 to form a gap therebetween, wherein when a trash bag 4 is placed in the lower container body 3, a peripheral edge of the trash bag 4 at an opening thereof can be folded outward and downward to pass through the gap between the inner pressing ring 22 and the outer pressing ring 21 such that the trash bag 4 can be completely mounted inside the trash container without exposing outside, as shown in FIG. 10.

According to the preferred embodiment of the present invention, the upper container body 1 further comprises a pair of shaft supporting bases 18 provided at a left sidewall and a right sidewall of the indented cavity 121 respectively, wherein the two end portions of the rotating shaft 14 are supported on the supporting bases 18 through bearings respectively.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An induction actuated trash container, comprising:

a lower container body having a storage cavity therein;

an upper container body which comprises:

a body seat mounted on said lower container body, a main housing body sealedly engaged on said body seat to define an enclosed interior space therebetween, wherein said main housing body has an indented cavity, a cover panel movably mounted to said main housing body to pivotally move between a closed position that said cover panel covers said storage cavity and an opening position that said cover panel is opened to expose said storage cavity to outside, a rotating shaft mounted across of said indented cavity of said main housing body and penetrates through a left sidewall and a right sidewall of said indented cavity, an actuation arm having one end coupled to said rotating shaft and another end coupled to said cover panel, and an induction actuated arrangement, disposed in said interior space, comprising an actuation output operatively coupled with one of two end portions of said rotating shaft for generating a rotational force to drive said rotating shaft to rotate and pivotally move said actuation arm to drive said cover panel between said closed position and said opening position; and a pressing ring provided between said upper container body and said lower container body for connecting said upper container body and said lower container body, wherein said pressing ring comprises an outer pressing ring and an inner pressing ring, wherein said outer pressing ring is provided between said upper container body and said lower container body for connecting said upper container body and said lower container body, wherein said inner pressing ring is mounted at an inner side of said outer pressing ring to form a gap therebetween, whereby when a trash bag is placed in storage cavity of said lower container body, a peripheral edge of the trash bag at said opening thereof is folded outward and downward to pass through said gap between inner pressing ring and said outer pressing ring.

2. The induction actuated trash container, as recited in claim 1, wherein said inner pressing ringing is mounted at a position lower than that of said outer pressing ring.

3. An induction actuated trash container, comprising:

a lower container body having a storage cavity therein;

an upper container body which comprises:

a body seat mounted on said lower container body, a main housing body sealedly engaged on said body seat to define an enclosed interior space therebetween, wherein said main housing body has an indented cavity, a cover panel movably mounted to said main housing body to pivotally move between a closed position that said cover panel covers said storage cavity and an opening position that said cover panel is opened to expose said storage cavity to outside, a rotating shaft mounted across of said indented cavity of said main housing body and penetrates through a left sidewall and a right sidewall of said indented cavity, wherein two end portions of said rotating shaft are enclosed and hidden in said interior space formed between said body seat and said main housing body, an actuation arm having one end coupled to said rotating shaft and another end coupled to said cover panel, and an induction actuated arrangement, disposed in said interior space, comprising an actuation output operatively coupled with one of said two end portions of said rotating shaft for generating a rotational force to drive said rotating shaft to rotate and pivotally move said actuation arm to drive said cover panel between said closed position and said opening position, wherein said induction actuated arrangement comprises an electric driving unit for providing a rotational force and a reduction gear unit coupled with said electric driving unit for transmitting said rotational force to one of said end portions of said rotating shaft, wherein said reduction gear unit comprises an output gear engaged with said sector gear, wherein said induction actuated arrangement further comprises a circuit board for controlling and powering said driving unit to drive;

a sector gear coupled on one of said end portions of said rotating shaft, wherein said actuation output of said induction actuated arrangement is operatively coupled with said sector gear; and a pressing ring provided between said upper container body and said lower container body for connecting said upper container body and said lower container body, wherein said pressing ring comprises an outer pressing ring and an inner pressing ring, wherein said outer pressing ring is provided between said upper container body and said lower container body for connecting said upper container body and said lower container body, wherein said inner pressing ring is mounted at an inner side of said outer pressing ring to form a gap therebetween, whereby when a trash bag is placed in storage cavity of said lower container body, a peripheral edge of the trash bag at said opening thereof is folded outward and downward to pass through said gap between inner pressing ring and said outer pressing ring.

4. An induction actuated trash container, comprising:

a lower container body having a storage cavity therein;

an upper container body which comprises:

a body seat mounted on said lower container body, a main housing body sealedly engaged on said body seat to define an enclosed interior space therebetween, wherein said main housing body has an indented cavity, a cover panel movably mounted to said main housing body to pivotally move between a closed position that said cover panel covers said storage cavity and an opening position that said cover panel is opened to expose said storage cavity to outside, a rotating shaft mounted across of said indented cavity of said main housing body and penetrates through a left sidewall and a right sidewall of said indented cavity, an actuation arm having one end coupled to said rotating shaft and another end coupled to said cover panel, wherein two end portions of said rotating shaft are enclosed and hidden in said interior space formed between said body seat and said main housing body, and an induction actuated arrangement, disposed in said interior space, comprising an actuation output operatively coupled with one of said two end portions of said rotating shaft for generating a rotational force to drive said rotating shaft to rotate and pivotally move said actuation arm to drive said cover panel between said closed position and said opening position, wherein said induction actuated arrangement comprises an electric driving unit for providing a rotational force and a reduction gear unit coupled with said electric driving unit for transmitting said rotational force to one of said end portions of said rotating shaft, wherein said reduction gear unit comprises an output gear engaged with said sector gear, wherein said induction actuated arrangement further comprises a circuit board for controlling and powering said driving unit to drive;

a sector gear coupled on one of said end portions of said rotating shaft, wherein said actuation output of said induction actuated arrangement is operatively coupled with said sector gear;

a resilient element provided on another one of said end portions of said rotating shaft, wherein said resilient element is biased against an inner surface of said main housing body for providing an urging force to balance a gravity of said cover panel; and a pressing ring provided between said upper container body and said lower container body for connecting said upper container body and said lower container body, wherein said pressing ring comprises an outer pressing ring and an inner pressing ring, wherein said outer pressing ring is provided between said upper container body and said lower container body for connecting said upper container body and said lower container body, wherein said inner pressing ring is mounted at an inner side of said outer pressing ring to form a gap therebetween, whereby when a trash bag is placed in storage cavity of said lower container body, a peripheral edge of the trash bag at said opening thereof is folded outward and downward to pass through said gap between inner pressing ring and said outer pressing ring.

5. The induction actuated trash container, as recited in claim 4, wherein said indented cavity is formed on said inner side of said main housing body at a rear side thereof.

* * * * *